US005572810A

United States Patent [19]

Farrington

[11] Patent Number: 5,572,810

[45] Date of Patent: Nov. 12, 1996

[54] STEAM IRON WITH ROTATABLE TEMPERATURE CONTROL

[75] Inventor: Richard I. Farrington, Seymour, Conn.

[73] Assignee: Black & Decker Inc., Newark, Del.

[21] Appl. No.: 512,852

[22] Filed: Aug. 9, 1995

[51] Int. Cl.[6] ..... D06F 75/26

[52] U.S. Cl. ..... 38/77.7

[58] Field of Search ..... 38/77.7, 77.8, 38/77.2; 219/250, 254

[56] References Cited

U.S. PATENT DOCUMENTS

| | | | |
|---|---|---|---|
| 2,342,653 | 2/1944 | Edwards | 38/77.7 |
| 2,342,716 | 2/1944 | Woodman | 38/77 |
| 2,655,746 | 10/1953 | McFarland et al. | 38/77 |
| 2,793,449 | 5/1957 | Seck | 38/7 |
| 2,813,358 | 11/1957 | Jepson | 38/77 |
| 2,871,588 | 2/1959 | Humphrey | 38/77 |
| 2,887,800 | 5/1959 | Kistner | 38/77 |
| 2,903,804 | 9/1959 | Kistner | 38/77 |
| 2,952,086 | 9/1960 | Kistner et al. | 38/77 |
| 2,976,627 | 3/1961 | Kistner et al. | 38/77.7 |
| 3,111,780 | 11/1963 | Smith | 38/77 |
| 3,368,294 | 2/1968 | Martin | 38/77 |
| 3,372,498 | 3/1968 | McCleerey | 38/77 |

FOREIGN PATENT DOCUMENTS

| | | | |
|---|---|---|---|
| 2800802 | 7/1979 | Germany | 38/77.7 |
| 767929 | 2/1957 | United Kingdom | 38/77.7 |

*Primary Examiner*—Ismael Izaguirre
*Attorney, Agent, or Firm*—Barry E. Deutsch

[57] ABSTRACT

A steam iron having a thermostat, a steam valve, and a rotatable temperature control. The control has a cam member with an outwardly extending flange having a worm thread section. The cam member operably connects a temperature control knob to the thermostat. A rocker is pivotably connected to the housing of the steam iron and operably connects the cam member to the steam valve.

13 Claims, 2 Drawing Sheets

STEAM IRON WITH ROTATABLE TEMPERATURE CONTROL

BACKGROUND OF THE INVENTION

1. Field of the Invention

The present invention relates to steam irons and, more particularly, to an iron with a rotatable control.

2. Prior Art

Steam irons may inadvertently cause water spotting and damage to clothes if a user forgets to turn off a steam function when ironing at low temperature settings. In the past, some manufacturers have used a bi-metal member for a steam valve to close the valve when temperatures are too low for good steam production. However, this is relatively costly. U.S. Pat. No. 2,793,449 discloses a steam iron with a temperature control dial with an interior facing cam surface and a steam valve moved by the cam surface. U.S. Pat. No. 2,887,800 discloses a cam member that adjusts a valve setting in a steam iron. Other related U.S. Patents including the following:

| | |
|---|---|
| U.S. Pat. No. 2,342,716 | U.S. Pat. No. 2,655,746 |
| U.S. Pat. No. 2,813,358 | U.S. Pat. No. 2,871,588 |
| U.S. Pat. No. 2,903,804 | U.S. Pat. No. 2,952,086 |
| U.S. Pat. No. 3,111,780 | U.S. Pat. No. 3,368,294 |
| U.S. Pat. No. 3,372,498 | |

SUMMARY OF THE INVENTION

In accordance with one embodiment of the present invention, in an iron having a steam valve and a rotatable temperature control operably connected to a thermostat, the improvement comprises the rotatable temperature control having a cam member with an outwardly extending flange having a worm thread section. The worm thread section is operably connected to the steam valve by a pivotable rocker. The rocker has a channel with the worm thread located therein.

In accordance with another embodiment of the present invention, in a steam iron having a rotatable temperature control with a cam surface, the rotatable temperature control is operably connected to a steam valve and a thermostat, the improvement comprises a member connecting the cam surface to a steam rod of the steam valve, the member extending from the rotatable temperature control in a general radial direction.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
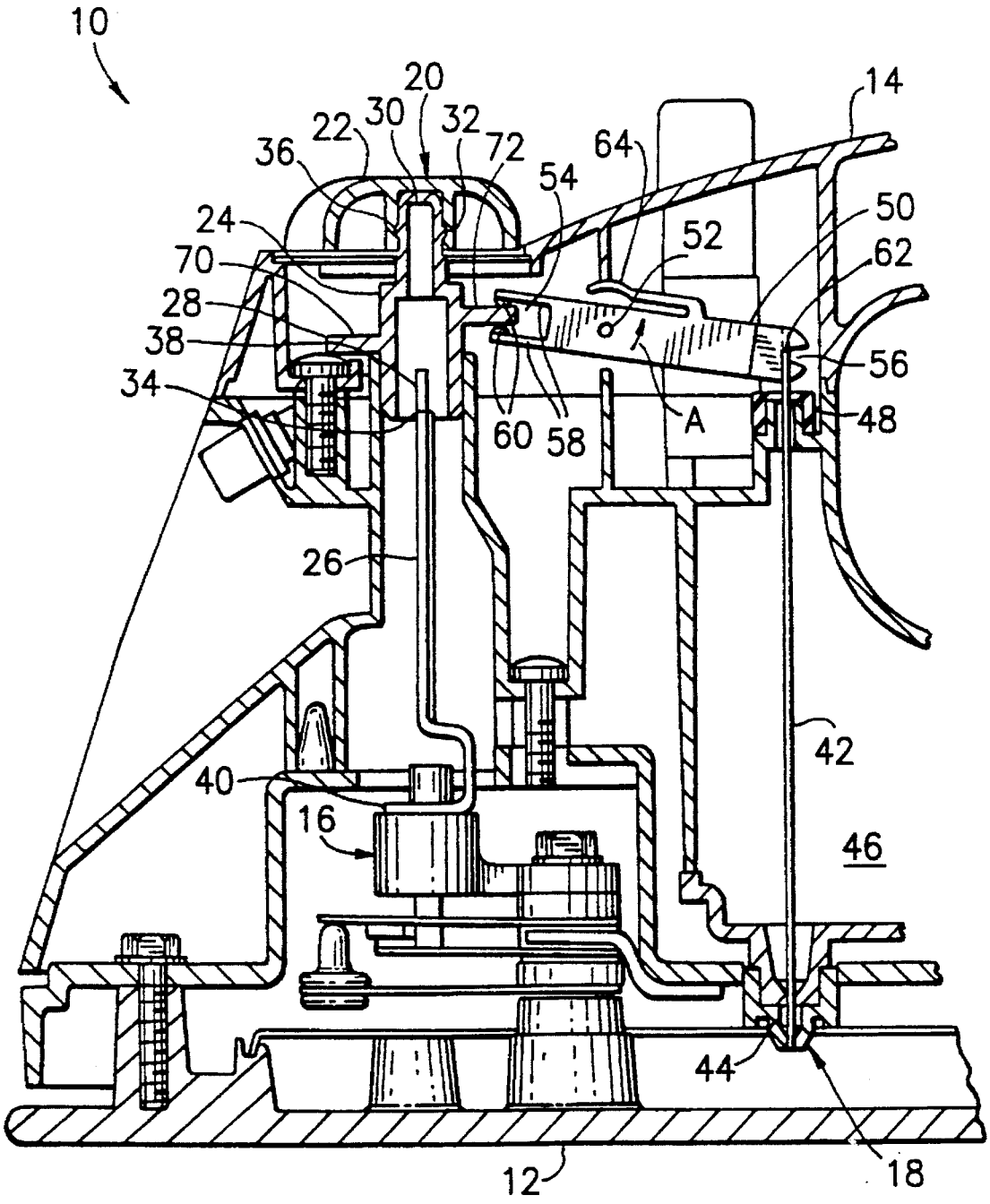
FIG. 1 is a cross-sectional view of a front portion of a steam iron incorporating features of the present invention.

Referring to FIG. 1, there is shown a cross-sectional view of the front portion of a steam iron 10 incorporating features of the present invention. Although the present invention will be described with reference to the single embodiment shown in the drawings, it should be understood that the present invention can be embodied in various different forms of alternate embodiments. In addition, any suitable size, shape or type of elements or materials could be used.

The iron 10 generally comprises a soleplate 12, a housing 14, a thermostat 16, a steam valve 18, and a temperature control 20. The control 20 includes a user actuatable knob 22, a cam member 24, and a connecting shaft 26. Referring also to FIG. 3, the cam member 24 has a general tube shape with an outwardly extending flange 28. The flange has three sections; a lower section 70, an upper section 72 and an angled section 74 between the upper and lower sections. In the embodiment shown, the flange 28 extends about 270° around the cam member 24 and the angled section 74 occupies about 20° around the cam member. However, in alternate embodiments, other suitable angles and dimensions could be provided. A top 30 of the cam member 24 forms a post with an annular raised ridge 32. The knob 22 is snap-lock mounted to the post 30 with the annular ridge 32 being received in the recess 36. The knob 22 and cam member 24 are coaxially aligned. The knob 22 is fixedly connected to the cam member 24 such that rotation of the knob 22 axially rotates the cam member 24. The bottom of the cam member 24 has a receiving area 34 that is suitably connected to the top 38 of the connecting shaft 26 such that axial rotation of the cam member 24 rotates the shaft 26. The bottom 40 of the shaft 26 is operably connected to the thermostat 16 to vary the setting of the thermostat. The steam valve 18 includes a steam rod 42 and a valve seat 44. The rod 42 is mounted to the iron for longitudinal movement between its fully closed position shown in FIG. 1 and its fully open position shown in FIG. 2. Area 46 is a water reservoir to hold water to be passed through the valve 18 and onto the soleplate 12. The rod 42 passes through a seal 48 located at the top of the reservoir 46.

A rocker 50 is pivotably mounted to the housing 14 at pivot 52. The rocker 50 has a front end with a channel 54 and a rear end with a slot 56. The channel 54 is formed by two deflectable arms 58. The arms 58 have opposing ribs 60. A portion of the flange 28 of the cam member 24 is located in the channel 54. The ribs 60 are located on the opposite top and bottom surfaces of the flange 28. The top end 62 of the steam rod 42 is located in the slot 56. The rocker 50 also has an integral spring arm 64 that is biased against the housing 14. The rocker 50 is arranged such that it extends from the cam member 24 in a general or substantial radial direction; at least in one position or one plane. However, in alternate embodiments the rocker 50 need not be generally radially arranged. For example, the rocker could be generally tangentially arranged relative to the cam member, but still mounted on the flange 28. The arms 58 need not be flexible. However, this has been found to compensate for tolerance variations. The ribs 60 help to compensate for variations due to angled movement of the rocker 50 relative to the cam member 24.

Figure 2:
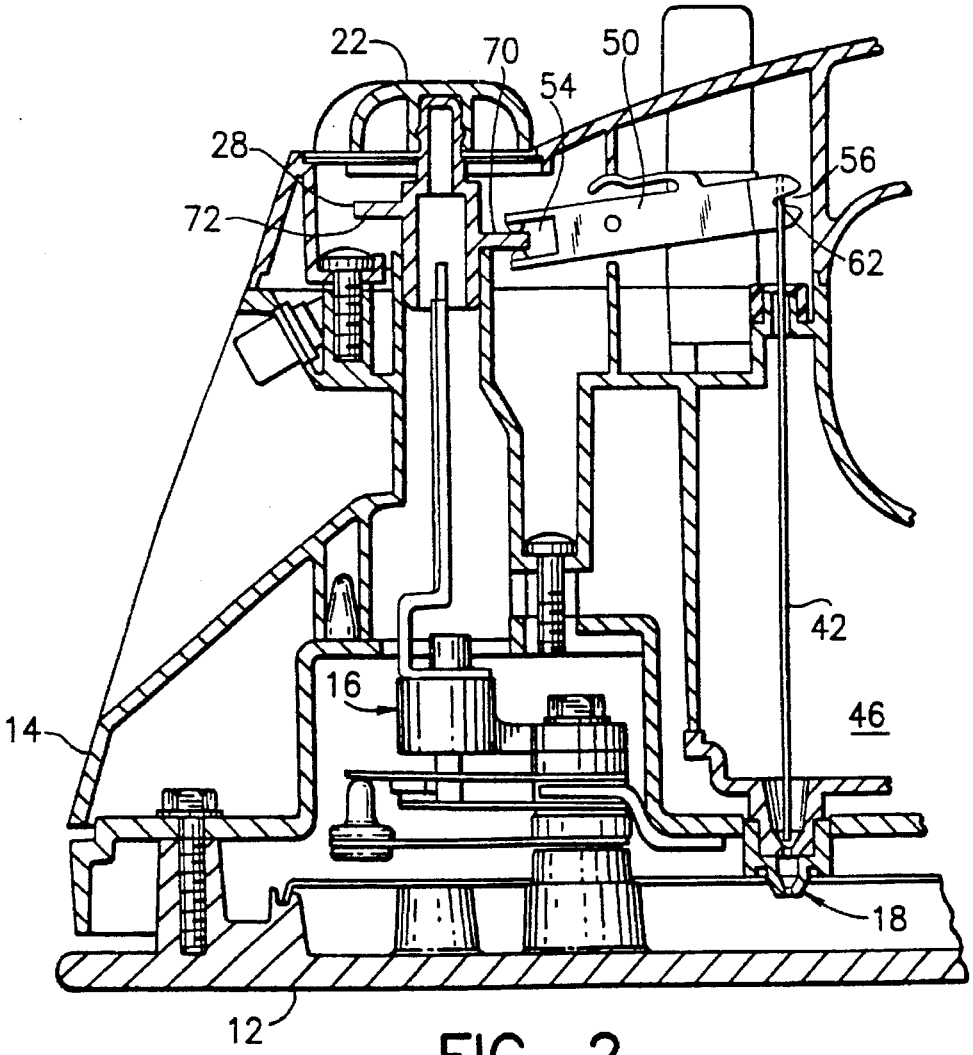
FIG. 2 is a cross-sectional view of the steam iron as shown in FIG. 1 with the temperature control located at a second position.
Figure 3:
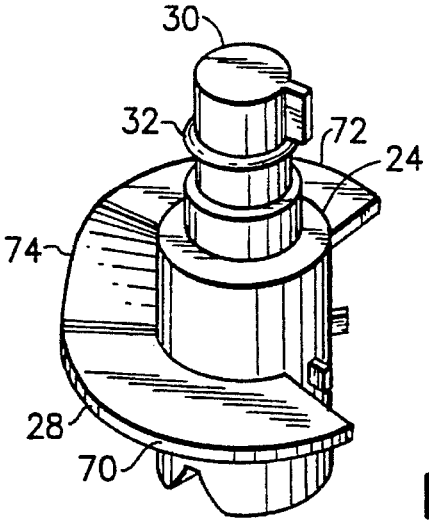
FIG. 3 is a perspective view of the cam member used in the iron shown in FIG. 1.

Referring to all the figures, when the user rotates the knob 22 from the OFF position shown in FIG. 1 to the desired temperature setting shown in FIG. 2, the thermostat 16 is moved by the cam member 24 and shaft 26 to that setting. In the OFF position shown in FIG. 1, the steam valve 18 is closed so no water will enter the steam chamber while the iron is OFF. However, due to the mechanical connection of the steam rod 42 to the cam member 24 by the rocker 50, when the cam member 24 is axially rotated, the rocker 50 moves the steam rod. More specifically, axial rotation of the cam member 24 causes the flange 28 to move. The front end of the rocker 50 rides on the flange 28 as it is rotated. The upper section 72 moves through the channel 54 such that the angled section 74 enters the channel 54. As the angled section 74 moves through the channel 54, this moves the front end of the rocker 50 from its up position shown in FIG. 1 towards the front down position shown in FIG. 2. The flange 28 functions similar to a worm thread inside the channel 54; at least along the angled section 74. Thus, the angled section is referred to herein as a worm thread section. Because of the pivotal connection of the rocker 50 on the housing 14, the rocker 50 pivots as shown by arrow A. This moves the rear end of the rocker 50 from its down position shown in FIG. 1 towards the rear up position shown in FIG. 2. When the rear end of the rocker 50 moves up, the rocker 50 moves the steam rod up because of the interlocking connection of the steam rod top 62 in the rear slot 56. When the user rotates the knob 22 back towards the OFF position, the cam member 24 pivots the rocker in the opposite direction to move the steam rod 42 back towards its closed position. Thus, rotation of the knob 22 both sets the thermostat 16 and opens the steam valve 18.

The top section 72 of the flange 28 has virtually no slope to keep the steam valve 18 totally closed at low temperatures. For rotation of the knob 22 to its highest temperature setting, the steam rod 42 is moved to its fully open position by the flange 28 and rocker 50. This allows the largest amount of flow of water through steam valve 18 at the high temperature setting. In alternate embodiments, the thread section on the cam member could have any suitable type of varied slope or pitch configuration. In another alternate embodiment, the cam member could have a cam slot that a projection from the rocker rides in. The pivot mount of the rocker to the housing could also be moved to one end of the rocker and the steam rod would be connected to and driven by the middle of the rocker. The present invention provides a relatively simple, cost effective, compact and dependable system to set the steam valve while also setting the thermostat which is not driven by thermal properties of the soleplate.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. In a steam iron having a steam valve and a rotatable temperature control operably connected to a thermostat, the improvement comprising:

the rotatable temperature control having a cam member with an outwardly extending flange, at least a portion of the flange forming a worm thread section, the flange being operably connected to the steam valve by a pivotable rocker, the rocker having a channel with the flange located therein.

2. A steam iron as in claim 1 wherein the rotatable temperature control has a user actuatable knob with the cam member being connected to the knob.

3. A steam iron as in claim 2 wherein the knob is snap-lock mounted on a post of the cam member.

4. A steam iron as in claim 3 wherein the knob is co-axially aligned with the cam member.

5. A steam iron as in claim 1 wherein the rotatable temperature control has a shaft that connects the cam member with the thermostat such that rotation of the cam member moves a setting of the thermostat.

6. A steam iron as in claim 1 wherein the rocker extends from the cam member in a general radial direction.

7. A steam iron as in claim 1 wherein the rocker has two deflectable arms that form the channel.

8. A steam iron as in claim 1 wherein the rocker has an integral spring arm that is biased against a portion of a housing of the steam iron.

9. A steam iron as in claim 1 wherein the rocker is connected to a steam rod of the steam valve to longitudinally move the steam rod when the rocker is pivotably moved.

10. In a steam iron having a rotatable temperature control with a cam surface, the rotatable temperature control being operably connected to a steam valve and a thermostat, the improvement comprise:

a member connecting the cam surface to a steam rod of the steam valve, the member extending from the rotatable temperature control in a general radial direction; said cam surface comprising a radially extending flange with a worm thread section, said member having a channel with said flange disposed therein.

11. A steam iron as in claim 10 wherein the member has two opposing deflectable arms that form the channel.

12. A steam iron as in claim 10 wherein the member is pivotably connected to a housing of the steam iron.

13. A steam iron as in claim 12 wherein the member has a slot with a portion of the steam rod therein to longitudinally move the steam rod when the member is pivotably moved.

* * * * *